US005971830A

United States Patent [19]

Tobin

[11] Patent Number: 5,971,830

[45] Date of Patent: Oct. 26, 1999

[54] CONSTRUCTABLE SPINNING TOP MAZE

[76] Inventor: Adam Zev Tobin, 1308 Sir Francis Drake, San Anselmo, Calif. 94960

[21] Appl. No.: 09/042,332

[22] Filed: Mar. 13, 1998

Related U.S. Application Data

[60] Provisional application No. 60/040,995, Mar. 18, 1997.

[51] Int. Cl.[6] ..... A63H 33/04; A63H 1/00; A63F 3/00

[52] U.S. Cl. ..... 446/256; 446/118; 446/259; 273/241; 273/287

[58] Field of Search ..... 446/111, 113, 446/118, 122, 256, 257, 259, 262, 263; 273/241, 249, 287

[56] References Cited

U.S. PATENT DOCUMENTS

| | | | |
|---|---|---|---|
| 1,317,640 | 9/1919 | Nussbeck | 446/256 |
| 1,364,632 | 1/1921 | Harrington | 446/256 |
| 1,935,542 | 11/1933 | Bursell | 446/118 |
| 2,671,663 | 3/1954 | Gurt et al. | 446/256 |
| 2,919,920 | 1/1960 | Heape | 446/262 |
| 3,429,573 | 2/1969 | Cederberg | 446/256 |
| 3,674,271 | 7/1972 | DeGelder et al. | 273/115 |

*Primary Examiner*—Kien T. Nguyen
*Assistant Examiner*—Laura Fossum
*Attorney, Agent, or Firm*—Laurence J. Shaw

[57] ABSTRACT

A constructable spinning top maze kit having a base upon which rail pieces may be removably mounted to form a maze through which the spinning top may travel when launched from a launcher. Multiple bases may be joined together in a single plane to create an indefinitely-extendable maze, or multiple bases may be assembled in multiple planes to create an indefinitely-extendable multi-level maze. Because rail pieces are removably mounted on the base pieces, a maze may be disassembled and reconstructed to form another maze have a completely different geometry, or one or more rail pieces may be repositioned to less drastically alter the geometry of the maze. As with the rail pieces, the launcher may be removably mounted on the base pieces. Therefore, the launcher may be positioned at a variety of locations in a maze, easily repositioned, and used within a variety of maze geometries. One or more pins may be placed on the base to provide a game with the objective of launching the top in a manner such that it will knock over the pins. The rail pieces may have downward-directed dowels with spacings which are integer multiples of a unit distance, and the base may have holes separated by the unit distance into which the dowels of the rail pieces may be inserted, thereby maximizing the number of rail configurations on the base.

13 Claims, 10 Drawing Sheets

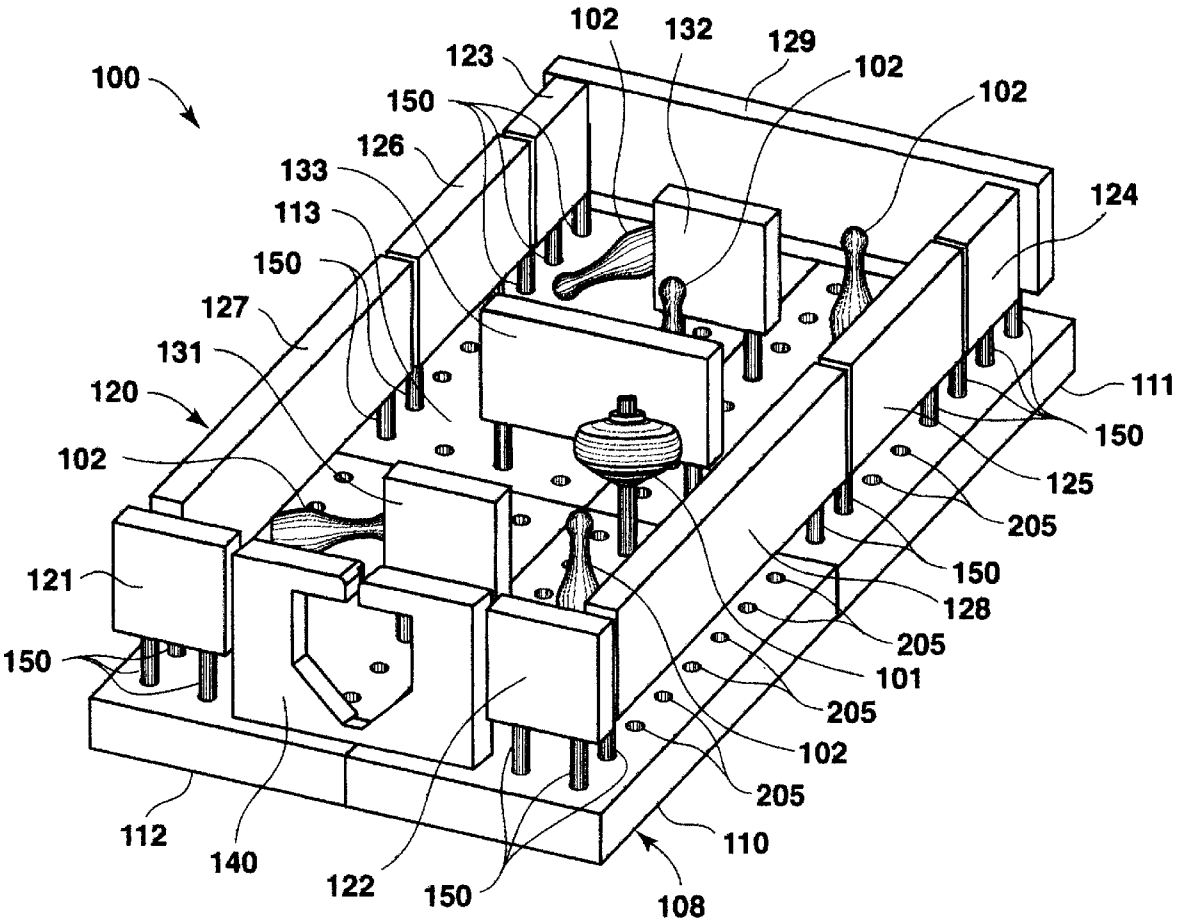
100
102
102
102

CONSTRUCTABLE SPINNING TOP MAZE

RELATED APPLICATIONS

The present regular patent application under 35 U.S.C. § 111(a) is based on the provisional application for Constructable Spinning Top Maze by Adam Zev Tobin, Ser. No. 60/040,995, filed on Mar. 18, 1997 under 35 U.S.C. § 111(b).

BACKGROUND OF THE INVENTION

The present invention relates generally to construction toys and games, and toys and games involving the spinning of tops and the like, and more particularly to a toy/game where a track or maze for a spinning top is constructed by the user.

In the game of "skittles" a player stands a number of pins upright in a maze, and then launches a top with the object of knocking over as many of the pins as possible. The player's score for a particular launch is equal to the number of pins which were knocked over. In a variation of the game, the pins are given different values depending on their location within the maze, with pins located in less accessible regions generally being assigned higher values, and the player's score is equal to the sum of the values of the pins which have been knocked over.

Currently, the geometry of such spinning top tracks is limited to two dimensions, and is not adjustable or changeable. These limitations act to somewhat restrict interest with the game.

However, providing a modular system where the player can design and construct the track, and play skittles games with the track which he or she constructed, greatly enhances the play value. Experimentation with various track geometries further enhances the play value and, in addition, is an entertaining way for a player to gain an intuitive understanding of the principal of the "random walk" (an important concept to the scientific understanding of phenomena such as air pressure).

Furthermore, a three-dimensional track system for a spinning top provides a range of interesting kinetic opportunities unavailable with a two-dimensional system. Due to the stability of spinning objects, the top can not only bounce off rails and other obstacles, it can go up and down ramps, and even fall off ledges and through "trap doors," while remaining spinning. In one alternate embodiment the top is even launched through the air to a higher level by a spring-loaded "ejector pad."

It is therefore a general object of the present invention to provide a construction toy, particularly a toy for construction of a maze through which a spinning top travels.

It is also a general object of the present invention to provide a three-dimensional track for a spinning top, particularly a three-dimensional track which may be constructed by the player.

It is another object of the present invention to provide a construction toy that allows the user to construct a spinning top track of multiple levels.

It is also an object of the present invention to provide a spinning top construction toy with removably connectable track pieces and rail pieces.

It is another object of the present invention to provide a spinning top construction toy where the track is built from modular removable interlocking parts, and can be built relatively high without likelihood of toppling.

It is another object of the present invention to provide a constructable spinning top track whose size can be extended indefinitely.

It is another object of the present invention to provide a spinning top track that allows for a top to fall from one track level to another.

It is another object of the present invention to provide a spinning top track in which multiple tops may spin.

It is another object of the present invention to provide a spinning top track in which the launching point of the top may be altered.

It is another object of the present invention to provide a spinning top track with more than one area adapted for the launching of a top.

More particularly, it is an object of the present invention to provide a toy comprised of track pieces, rail pieces, and dowels for construction of an enclosed system through which a spinning top may travel.

Further objects and advantages of the present invention will become apparent from a consideration of the drawings and the ensuing detailed description. These various embodiments and their ramifications are addressed in greater detail in the Detailed Description.

DETAILED DESCRIPTION

Figure 2C:
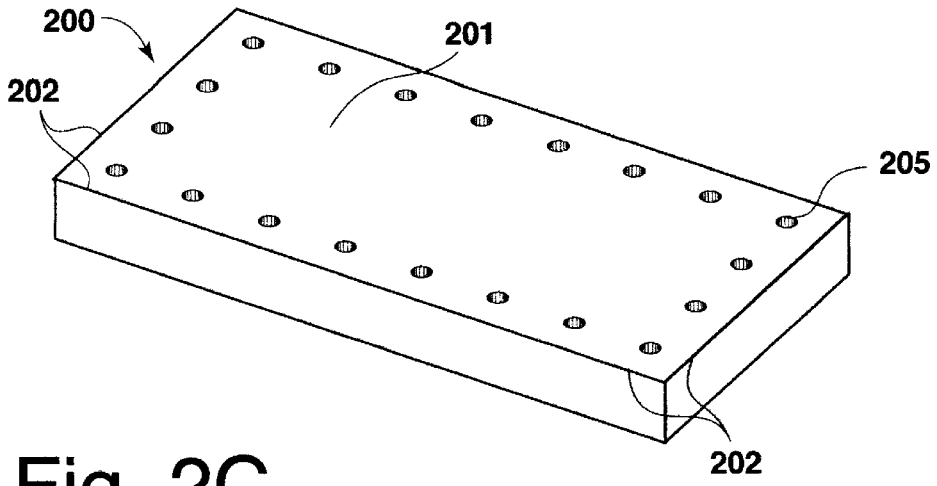
Figure 2A:
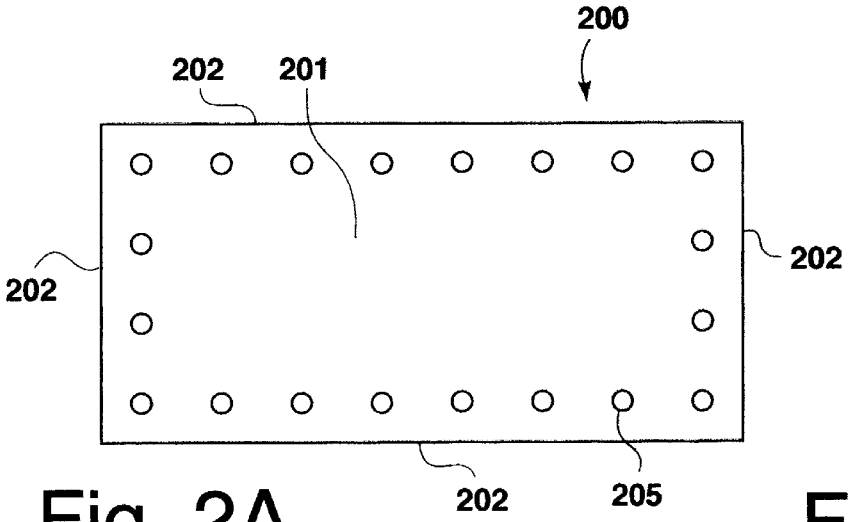
Figure 2D:
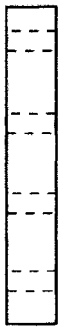
Figure 2B:
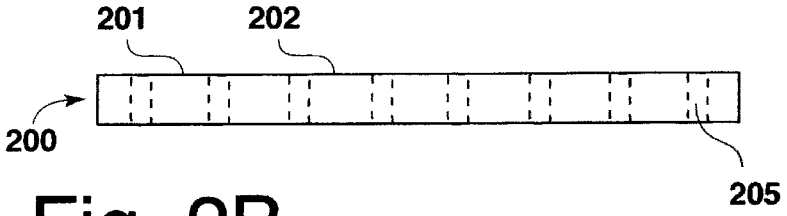
Figure 3A:
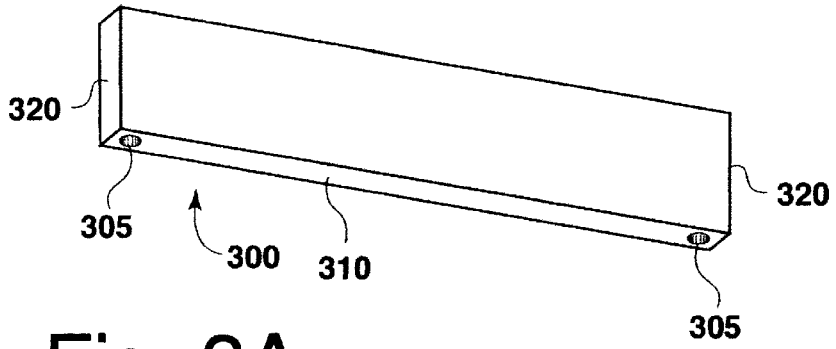
Figure 3C:
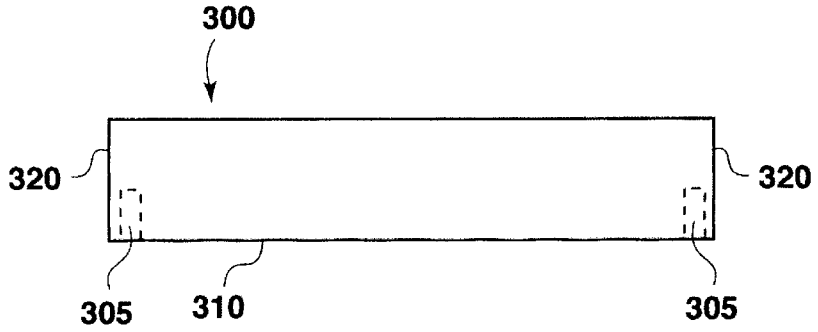
Figure 3D:
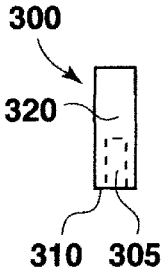
Figure 3B:
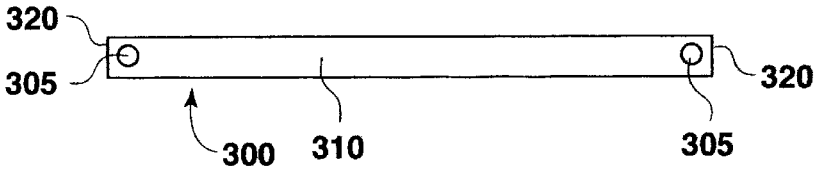
Figure 4A:
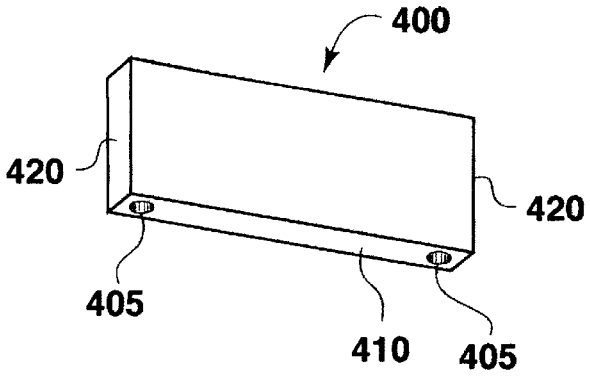
Figure 4C:
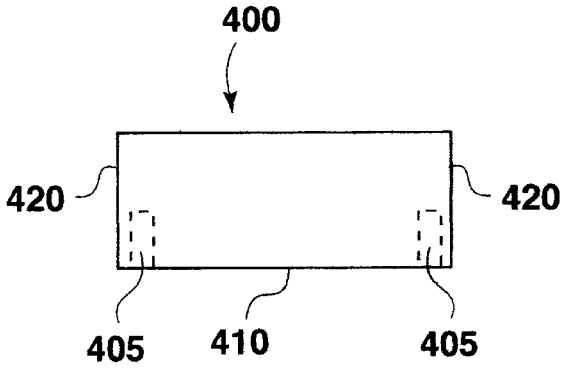
Figure 4D:
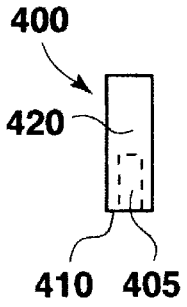
Figure 4B:
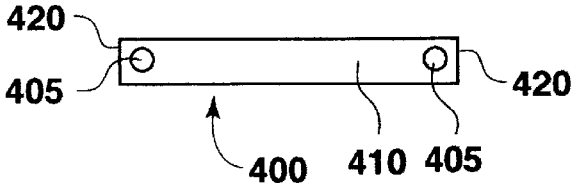
Figure 5A:
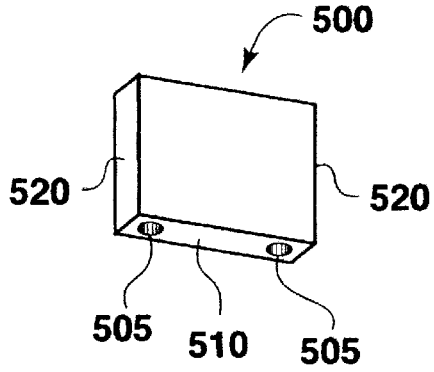
Figure 5C:
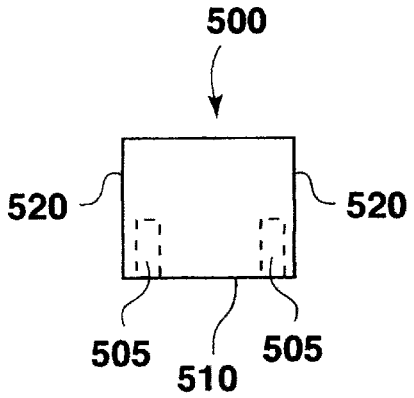
Figure 5D:
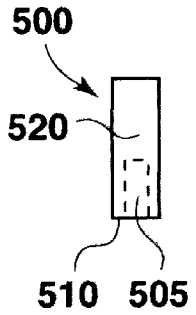
Figure 5B:
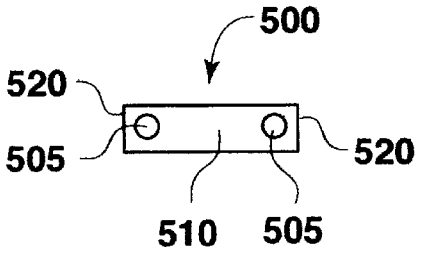

The present invention is directed to a construction set for assembly of a track for a spinning top. A wide variety of track configurations, including multi-level and bifurcated track geometries, may be constructed. The construction set includes a launcher for launching the top, and pins which may be placed along the track. Once the track is constructed, the game of skittles (where the player attempts to launch the top with sufficient energy that the top will traverse enough of the track to knock over all the pins) may be played.

An exemplary top track (100) is shown in the perspective view of FIG. 1. The base (108) of a top track consists of four base blocks (110, 111, 112, 113) which are placed side face-to-side face such that comers of each of the four base blocks (110–113) meet at a point. The top (101) launched from the launcher (140) is shown having traversed enough of the base (108) to topple two of the five pins (102) which have been placed on the track (100).

As shown in the top, long-edge cross-sectional, perspective and short-edge cross-sectional views of FIGS. 2A, 2B, 2C and 2D, respectively, a base block (200) is a rectangular parallelapiped with ¼" diameter holes (205) drilled therethrough along the perimeter of the top face (201) at regular intervals. Because the holes (205) of the base block (200) are spaced at 1" intervals and inset 0.5" from the top edge (202), the holes (205) in a tiling of base blocks (200) with aligned comers and abutting side faces are always located at points on a 1"×1" lattice.

The base (8) of the track system (100) shown in FIG. 1 is surrounded by an exterior rail system (120) consisting of four 2-unit rail pieces (121, 122, 123, 124), two 4-unit rail pieces (125, 126), three 8-unit rail pieces (127, 128, 129) and a launcher (140). Barriers interior to the exterior rail system (120) include two 2-unit rail pieces (131, 132) and a 4-unit rail piece (133).

Perspective, bottom, front cross-sectional and side cross-sectional views of the 8-unit rail piece (300) are shown in FIGS. 3A, 3B, 3C and 3D, respectively. Similarly, perspective, bottom, front cross-sectional and side cross-sectional views of the 4-unit rail piece (400) and 2-unit rail piece (500) are shown in FIGS. 4A, 4B, 4C and 4D, and FIGS. 5A, 5B, 5C and 5D, respectively. Each rail piece (300, 400, 500) has a pair of ¼"-diameter holes (305, 405, 505) drilled perpendicular to the bottom surface (310, 410, 510).

The 8-unit, 4-unit and 2-unit rail pieces (300, 400, 500) have end face-to-end face lengths of 7.5", 3.5" and 1.5". Since the center of the holes (305, 405, 505) are inset 0.5" from the nearest end face (320, 420, 520), the holes (305, 405, 505) in the 8-unit, 4-unit and 2-unit rail pieces (300, 400, 500) are separated by 7", 3" and 1", respectively.

As shown in FIG. 1, each rail piece (121–129, 131–133) is mounted on the base (108) by a pair of ¼"-diameter dowels (150) inserted into the two holes (305, 405, 505) in the bottom of the rail piece (121–129, 131–133) and two holes (205) in the base blocks (110–113). Because the holes (205) in the base (108) are located on points on a 1" by 1" lattice, and the holes (305, 405, 505) in the rail pieces (300, 400, 500) are separated by an integer number of inches, there is clearly a wide variety of alternate arrangements of rail pieces (300, 400, 500).

Figure 6:
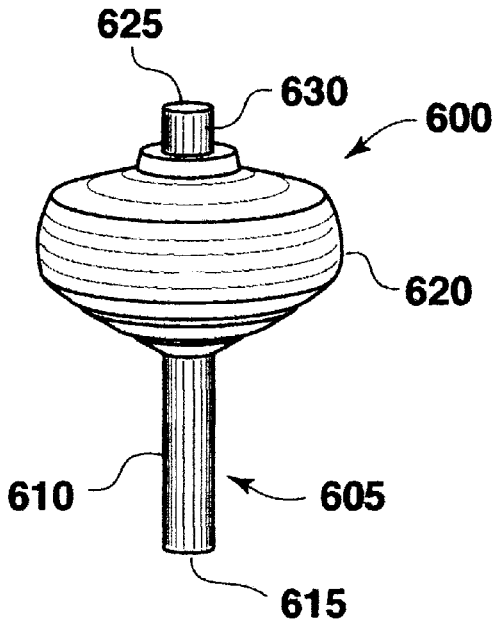

A side view of the top (600) is shown in FIG. 6. The top (600) has a spindle (605) having a bottom portion (610) and a top portion (630). Mounted on the spindle (605) between the top and bottom portions (630, 610) is a cylindrically symmetric mass (620). The bottom (615) of the spindle is flat and the mass (620) is mounted closer to the top (625) of the spindle (605) than the bottom (615) so the top (600) will tend to wander as it spins.

Perspective, front cross-sectional, side cross-sectional and bottom views of a launcher (700) are shown in FIGS. 7A, 7B, 7C and 7D, respectively. The launcher (700) has a central aperture (710) with dimensions sufficient to accept the mass (620) of the top (600), and a slot (705) from the top face (720) to the aperture (710). The bottom surface (750) of the launcher (700) has a pair of ¼"-diameter holes (730) with longitudinal axes perpendicular thereto. It should be noted that the depth of the holes (730) in the launcher (700) is substantially greater than the depth of the holes (305, 405, 505) in the rail pieces (400, 500, 600), providing the launcher (700) with additional stability. The holes (305, 405, 505) have a depth which insures that the bottom (750) of the launcher (700) rests against the base (108), that the bottom 615 of the top (600) can rest against the base (108) during the launch of the top (600).

Figure 8:
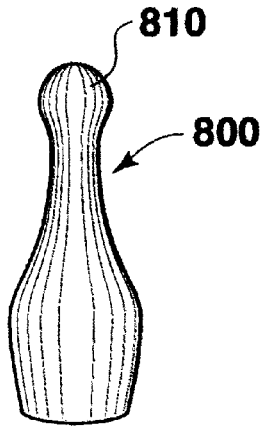
Figure 7A:
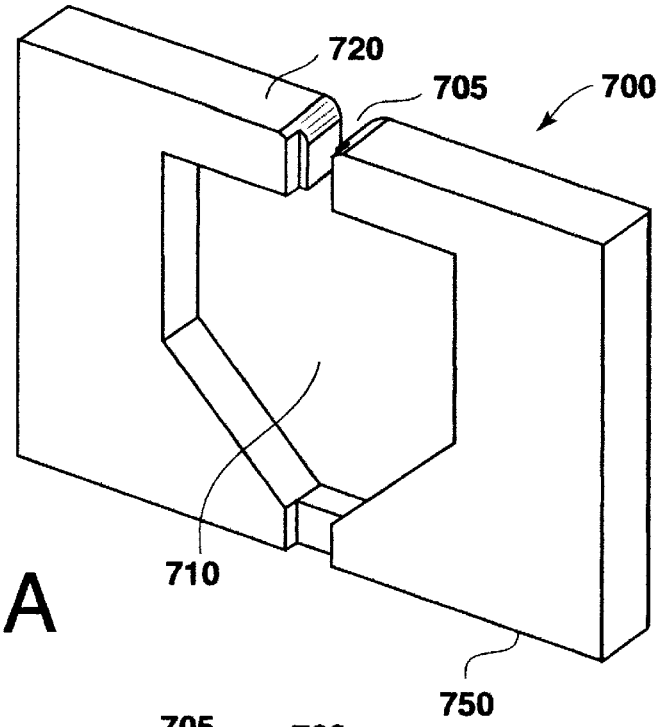
Figure 7B:
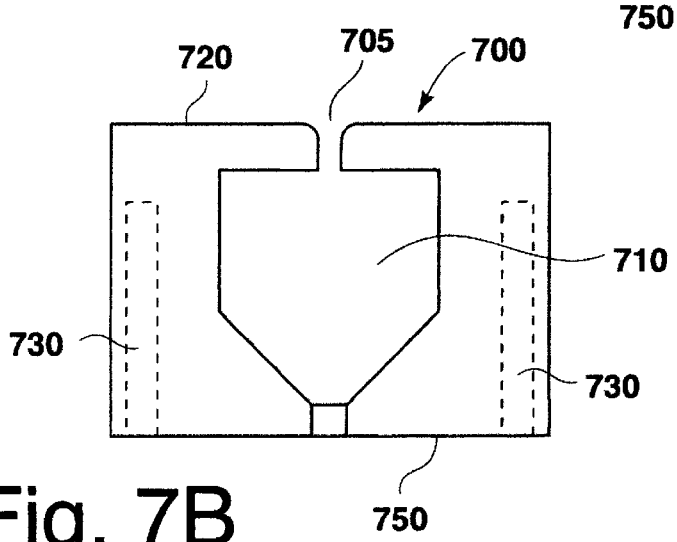
Figure 7C:
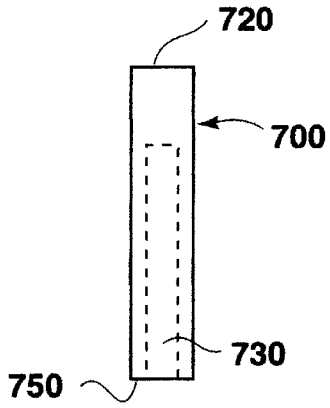
Figure 7D:
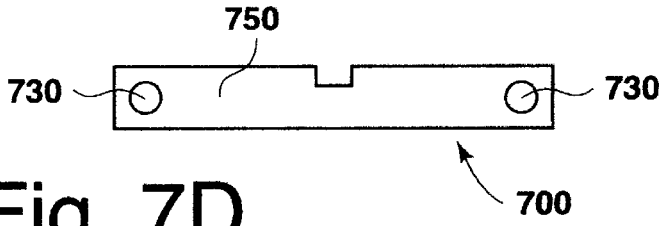

A pin (800) is shown in cross-section in FIG. 8. The dimensions of the pin (800) are not critical, except that the top (810) of the pin (800) should have a height approximately the same as the height of the mass (620) of the top (600).

To launch the top (600) from the launcher (700), a chord with a handle (not shown) is wrapped around the lower portion (610) of the spindle (605), and the mass (620) of the top (600) is placed in the aperture (710) with the upper portion (630) of the spindle (605) against the slot (705) of the launcher. The top (600) is then launched by pulling the handle rapidly away from the launcher (700).

Figure 9A:
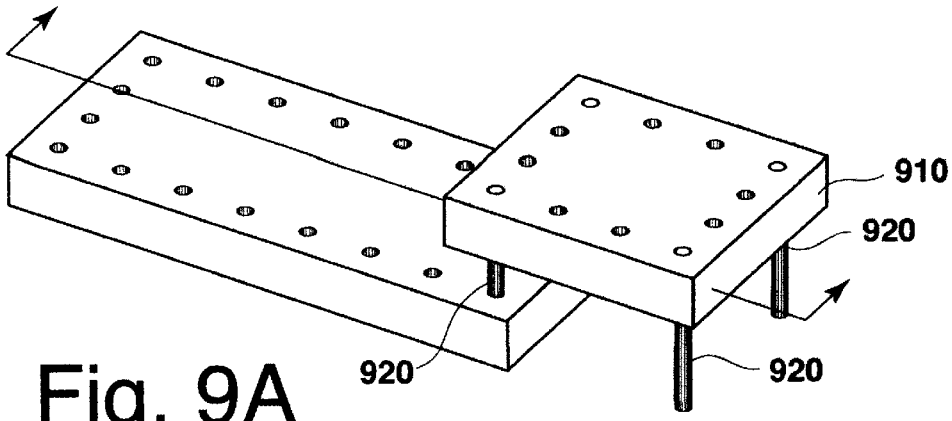
Figure 9B:
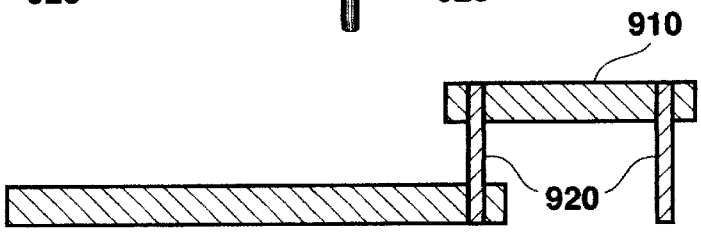
Figure 10A:
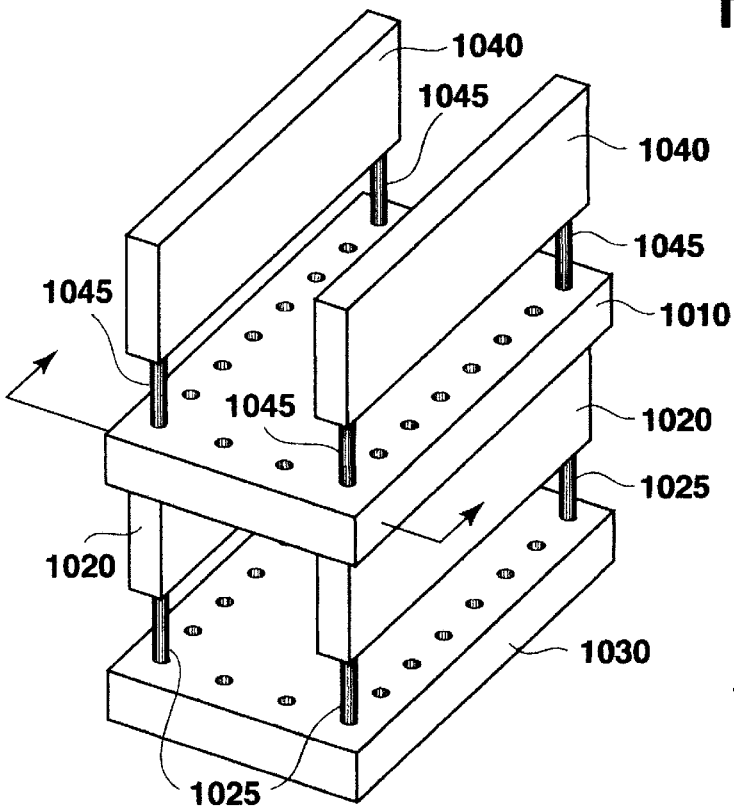
Figure 10B:
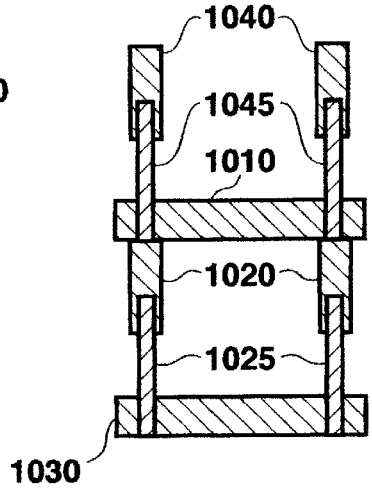

Although a single-level track construction (100) is shown in FIG. 1, multilevel track can be constructed by mounting a base block (910) on the upper portions of pegs (920), as shown in the perspective and side views of FIGS. 9A and 9B. Alternatively, as shown in the perspective and side views of FIGS. 10A and 10B, a multi-level track can be constructed by mounting a base block (1010) on the rail pieces (1020) from a previous level. As shown in FIGS. 10A and 10B, the lower 8-unit rail pieces (1020) are mounted via pegs (1025) in a base block (1030) and the upper base block (1010) has a pair of 8-unit rail pieces (1040) mounted on it (1010) via pegs (1045).

Figure 11:
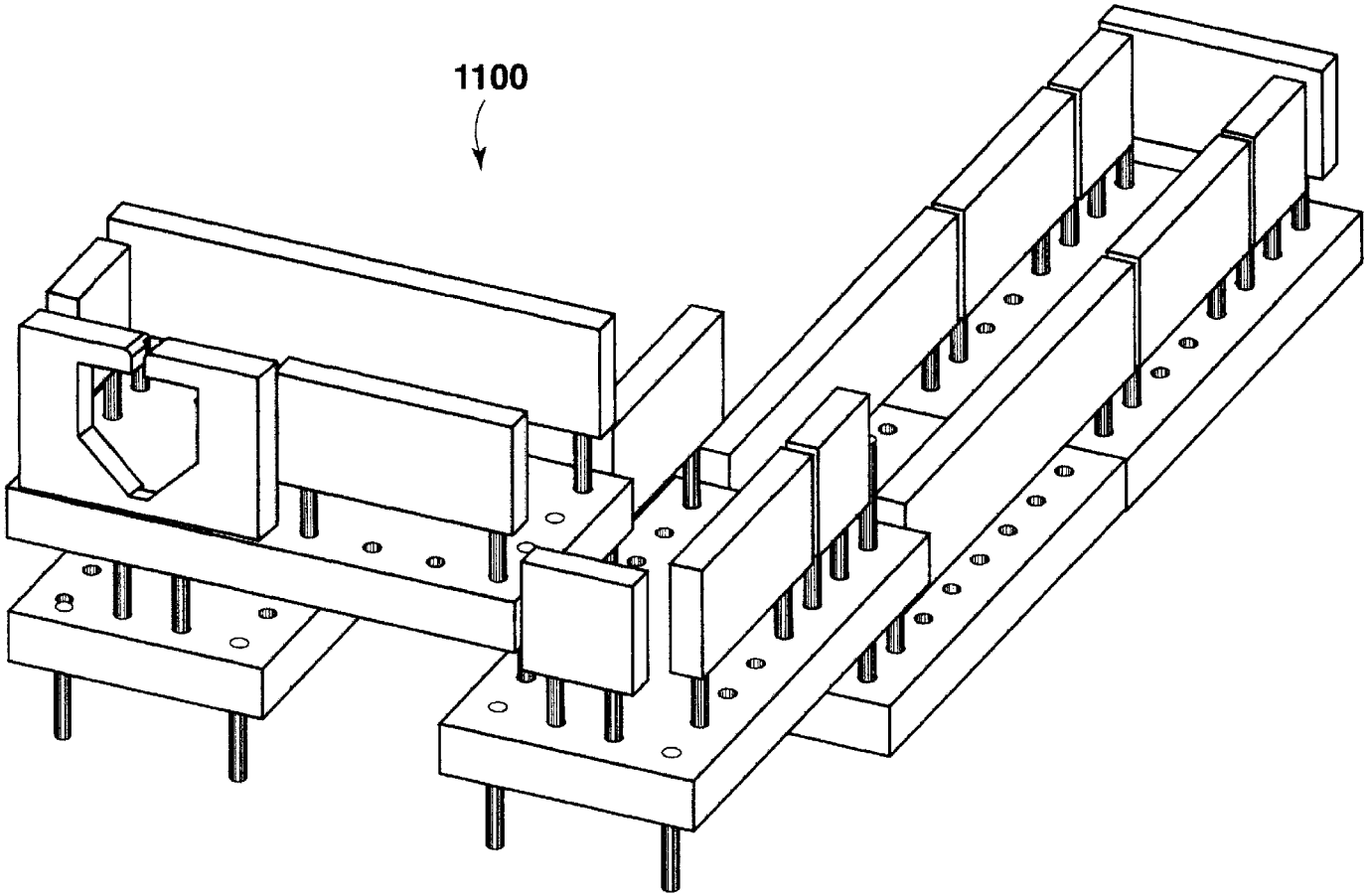

A multi-level track (1100) using the multi-level construction means shown in FIGS. 9A and 9B, is shown in FIG. 11.

Figure 12:
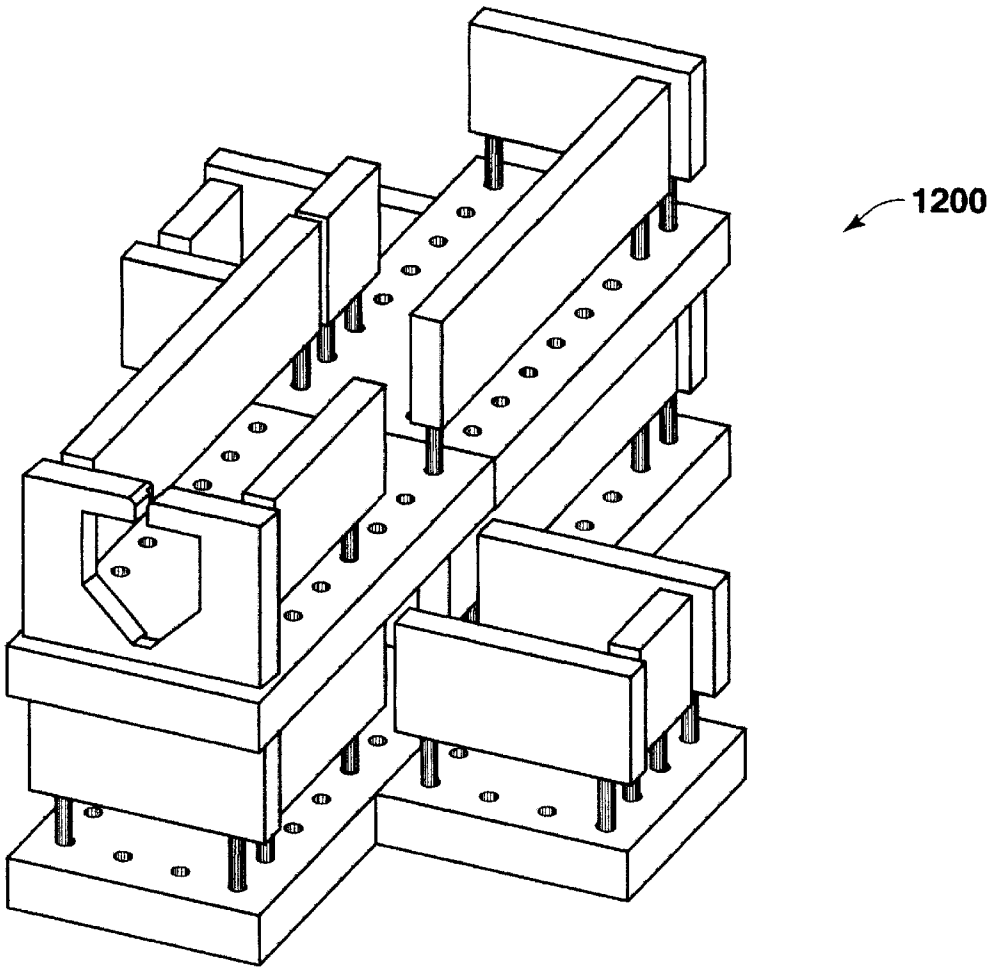

A multi-level track (1200) using the multi-level construction means shown in FIGS. 10A and 10B, is shown in FIG. 12.

While the above description contains many specificities, these should not be construed as limitations on the scope of the invention, but rather as exemplifications of preferred embodiments thereof. Many other variations are to be considered within the scope of the present invention. For instance: the rails may be attached to the track pieces in another manner; the track pieces need not have the specified pattern of holes; a track piece may have holes which form a grid pattern; the toy may be built on a single large track piece with a grid of holes; a string or elastic band may be used to provide a rail; pegs may be integrally formed with a rail piece; a rail may be movable or rotatable so its position may be altered by the top or by the player; a track piece may have one or more integrally-formed rails; a track piece may have one or more grooves in its upper surface, within which a top would be constrained once located therein; the track pieces need not have straight edges; the path provided by a track piece may be curved; the upper surface of a track piece may have a nonuniform height; a track pieces may be adapted to function as a ramp for interconnecting different levels of the track; the track may include springs or the like which may launch a top to a higher level of the track; the track may include trap doors or the like through which a top would fall to a lower level of the track; a track piece may include an aperture through which a top could fall to a lower level of the track; the rails may have appealing acoustic properties when struck by the top; the modular track system may include bells or other percussive elements which would emit tones or other distinctive sounds when struck by the top; the system may include an electrical or mechanical switch which, when struck by the top, would activate a light, relay, lever arm, etc.; a rail piece may be adapted for interconnection with other rail pieces, and therefore not require a means for securement to the track pieces; the track pieces and/or rail pieces may by decorated to have the appearance of a miniature race course, city, golf course, etc.; the pins or the top may be decorated with the likeness of a character; the pins could have other shapes; the object of the game may instead be to avoid knocking over the pins; the top may be launched by another means, such as a spring-loaded or electrical launcher; the launching system for the top need not be attached to the track system; the system may include more than one top launcher and/or more than one top; the top may be magnetic and the track may include magnetic barriers; the maze formed by the rail pieces may be extremely simple, and for instance a maze may consist of a unobstructed partially-enclosed area or even an open area having only a single rail piece or a small number of rail pieces; etc. Many other variations are also to be considered within the scope of the present invention. Thus, the scope of the invention should be determined not by the examples given herein, but rather by the appended claims and their legal equivalents.

What is claimed is:

1. An amusement system, comprising:

a top;

a first base having a first lower surface and a first upper surface, and a first side surface having a first contour;

a first plurality of first rail members removably mountable in a variety of configurations on said first base to form a firs series of barriers to motions of said top; and a launcher for imparting a spin on said top and directing said top to said first upper surface of said first base.

2. The amusement system of claim 1 further including a pin placed on said first upper surface of said first base, said pin being displaced upon collision of said top with said pin.

3. The amusement system of claim 1 further including a second base having a second upper surface and a second side surface, and a second plurality of second rail members removably mountable in a variety of configurations on said second base to form a second series of barriers to motions of said top, said second side surface having a second contour complementary to said first contour so that said first and second bases may be abutted to allow said top to travel between said first and second upper surfaces and navigate both said first and second series of barriers.

4. The amusement system of claim 3 wherein one of said rail members may be removably mounted on both said first and second bases to fix the positional relationship of said first and second bases.

5. The amusement system of claim 1 further including a second base having a second upper surface, and a second plurality of second rail members removably mountable in a variety of configurations on said second base to form a second series of barriers to motions of said top, and wherein said first upper surface of said first base has a height greater than said second upper surface of said second base and an edge portion of said first upper surface of said first base accessible by said top is located above said second upper surface of said second base, so that said top may fall from said edge portion of said first base to said second base, and navigate said second series of barries.

6. The amusement system of claim 5 wherein said first lower surface of said first base is rested on upper surfaces of said second plurality of second rail members.

7. The amusement system of claim 1 wherein said first plurality of rail members are removably mountable on said first base with a finite number of discrete orientations at discrete locations.

8. The amusement system of claim 7 wherein said first plurality of rail members are removably mountable on said first base with either a first orientation or a second orientation perpendicular to said first orientation.

9. The amusement system of claim 8 wherein said first plurality of rail members are removably mountable on said first base at discrete locations on a regular two-dimensional grid.

10. The amusment system of claim 1 wherein said first base has a third plurality of first holes with longitudinal axes parallel to a normal vector of said first upper surface, said first holes being located at points on a regular two-dimensional grid, and said first series of barriers have dowels extending therefrom which are removably insertable into said first holes in said first base.

11. The amusement system of claim 1 wherein said first base has a third plurality of first holes of a first width with longitudinal axes parallel to a first normal vector of said first upper surface, said first holes being located at points on a regular two-dimensional grid based on a fundamental length, and each of said first series of barriers has second holes of said first width with longitudinal axes parallel to a second normal vector of a first bottom surface of said each of said first series of barriers, said second holes being separated by an integer multiple of said fundamental length, and further including dowels of said first width for insertion into said first and second holes to removably mount said first series of barriers on said first base.

12. The amusement system of claim 11 wherein said launcher has third holes of said first width with longitudinal axes parallel to a third normal vector of a second bottom surface of said launcher, said third holes being separated by said integer multiple of said fundamental length, said dowels being removably insertable into said first and third holes to removably mount said launcher on said first base.

13. The amusement system of claim 11 wherein said launcher is removably mountable in a variety of locations on said first base.

* * * * *